US007439470B2

(12) United States Patent
Bailey et al.

(10) Patent No.: US 7,439,470 B2
(45) Date of Patent: Oct. 21, 2008

(54) METHOD AND APPARATUS FOR VIBRATING A SUBSTRATE DURING MATERIAL FORMATION

(75) Inventors: Jeffrey A. Bailey, Richland, WA (US); Johnson N. Roger, Richland, WA (US); Munley T. John, Benton City, WA (US); Park R. Walter, Benton City, WA (US)

(73) Assignee: Battelle Memorial Institute, Richland, WA (US)

( * ) Notice: Subject to any disclaimer, the term of this patent is extended or adjusted under 35 U.S.C. 154(b) by 592 days.

(21) Appl. No.: 11/035,463

(22) Filed: Jan. 13, 2005

(65) Prior Publication Data

US 2006/0151073 A1 Jul. 13, 2006

(51) Int. Cl.
*B23K 9/04* (2006.01)
*C21D 10/00* (2006.01)

(52) U.S. Cl. ..... 219/76.13; 148/558

(58) Field of Classification Search ..... 219/76.13; 148/558

See application file for complete search history.

(56) References Cited

U.S. PATENT DOCUMENTS

| | | | | |
|---|---|---|---|---|
| 3,677,831 | A * | 7/1972 | Pezaris et al. | 148/508 |
| 4,386,727 | A | 6/1983 | Unde | |
| 6,223,974 | B1 | 5/2001 | Unde | |
| 6,338,765 | B1 * | 1/2002 | Statnikov | 148/558 |

OTHER PUBLICATIONS

M.Saito Y. Imanishi, Host-guest composites containing ultrasonically arranged particles, Journal of Material Science (2000) pp. 2373-2377.

* cited by examiner

*Primary Examiner*—Kevin P Kerns
(74) *Attorney, Agent, or Firm*—Allan C. Tuan

(57) ABSTRACT

A method and apparatus for affecting the properties of a material include vibrating the material during its formation (i.e., "surface sifting"). The method includes the steps of providing a material formation device and applying a plurality of vibrations to the material during formation, which vibrations are oscillations having dissimilar, non-harmonic frequencies and at least two different directions. The apparatus includes a plurality of vibration sources that impart vibrations to the material.

9 Claims, 2 Drawing Sheets

METHOD AND APPARATUS FOR VIBRATING A SUBSTRATE DURING MATERIAL FORMATION

STATEMENT REGARDING FEDERALLY SPONSORED RESEARCH OR DEVELOPMENT

This invention was made with Government support under Contract DE-AC0576RLO1830 awarded by the U.S. Department of Energy. The Government has certain rights in the invention.

SUMMARY

Embodiments of the present invention encompass methods and apparatus for vibrating a material during its formation (i.e., "surface sifting"), thereby affecting the properties of the material. The method comprises the steps of providing a material formation device and applying a plurality of vibrations to the material during formation. The plurality of vibrations comprises oscillations having dissimilar, non-harmonic frequencies and at least two different directions.

The apparatus comprises a plurality of vibration sources imparting vibrations to a material. The vibration sources generate vibrations having dissimilar, non-harmonic frequencies and oscillations in at least two different directions.

DESCRIPTION OF DRAWINGS

Embodiments of the invention are described below with reference to the following accompanying drawings.

DETAILED DESCRIPTION

Figure 1:
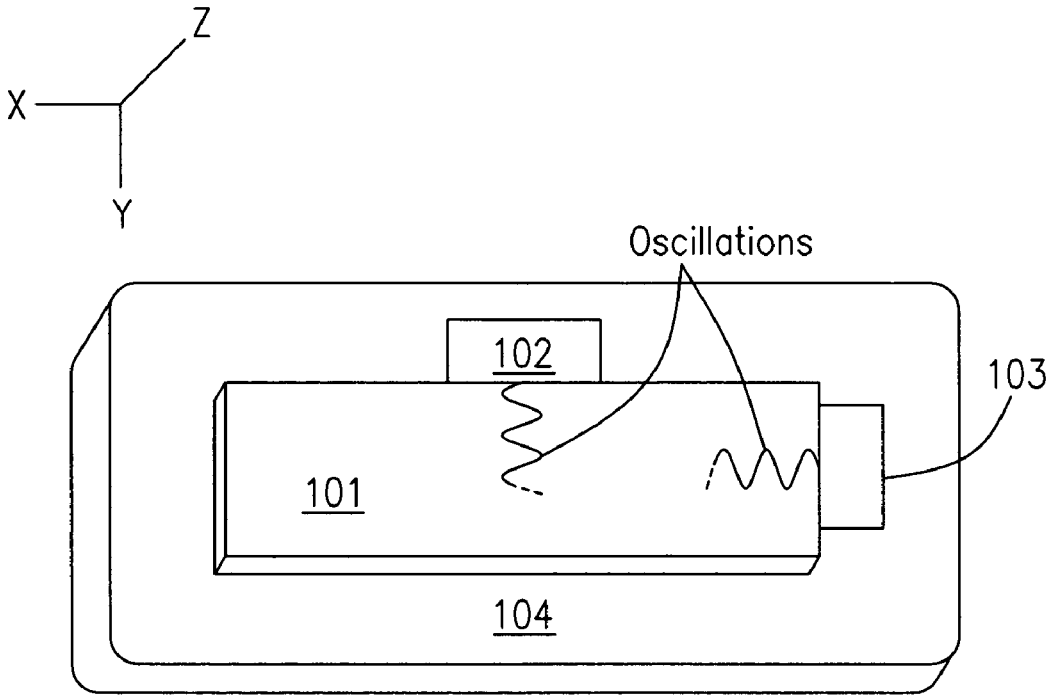
FIG. 1 is a schematic illustration of one embodiment comprising two vibration sources.

For a clear and concise understanding of the specification and claims, including the scope given to such terms, the following definition is provided.

A material formation device, as used herein, comprises an apparatus for forming materials, especially when the material changes phases from a solid, a fluid, or a solid powder, to a cohesive solid. The device can be applied to processes including, but not limited to, material deposition, film growth, fabrication, surface repair, bulk growth, component joining, molding, and coating. Specific examples of a material formation device can include, but are not limited to, apparatuses for electro-spark deposition (ESD), spray coating, welding, spin coating, casting, high-velocity oxide spraying (HVOS), chemical electroplating, crystal fabrication, polymer molding, and combinations thereof.

A target surface, as used herein, can refer to the region proximal to the formation front during material formation. For example, when repairing a relatively small defect on the surface of a large component, the target surface can encompass the region of the defect, where material formation occurs and is intended.

Vibrations during material formation can alter the properties of a material of interest. For example, according to embodiments of the present invention, semi-random movement resulting from vibrations during material formation can distribute stresses associated with a particular formation process and reduce/eliminate cumulative stresses, which can lead to cracks and other defects in the material. Additionally, vibrations during material formation can minimize porosity and the number of inclusions in the material by "sifting" out such defects.

Suitable oscillation frequencies can be application and material dependent, yet still fall within the scope the present invention. In one embodiment, the frequencies of each vibration can be greater than or equal to approximately 1 kHz, and would not result in net movement. The vibrations can be applied and/or transmitted directly to the material with a variety of vibration sources including, but not limited to piezoelectric transducers, mechanical motors, electromagnetic devices, laser-based sources, acoustic devices, and combinations thereof. In addition to, or as an alternative to, applying vibrations directly to the material, the vibrations can be applied to an article that contacts the material of interest. Instances of applying vibrations to an article can include, but are not limited to, coupling the vibrations to substrates for films/coatings, molds for forming ceramic articles, components having surface damage, and vessels containing molten material for crystal growth. For example, a substrate on which a coating will be formed can be coupled to a vibration source. By vibrating the substrate, the deposited material will itself be vibrated during formation of the coating.

Selection of a particular vibration source would depend on the intended application. For example, a target surface surrounded by fluid that damps oscillations might couple less effectively to an acoustic vibrator than to an electromagnetic or laser-based device, which could transmit vibrations through the fluid to the target surface. Similarly for applications in vacuum, an optically-based system can be effective. A mechanical motor can be utilized to vibrate the molds for forming a large ceramic article, while piezoelectric transducers can be used to vibrate a substrate for film deposition.

A non-limiting example of an electromagnetic device comprises an electromagnetic acoustic transducer (EMAT). An EMAT can comprise a static magnetic field and a current-carrying wire, which can induce an eddy current in a nearby material. EMATs can transmit vibrations to a nearby substrate without the use of a coupling material such as oils. Laser-based sources can comprise devices utilizing lasers to generate a pulse and/or vibration. For example, a focused laser beam can produce enough localized heat to generate a spark at the focal point, which can be accompanied by an acoustic shock wave. Thus, one example of a laser-based vibration source can comprise a train of laser-induced acoustic waves. Another example can comprise impinging a component with a laser having a wavelength that the component absorbs. The interaction can result in rapid localized heating and produce thermal shock waves in the component. In order to minimize unintended and/or undesirable temperature effects, the laser-heated area should be sufficiently distant from the target surface where material formation occurs. Furthermore, when necessary, the vibration sources should be electrically insulated from the material of interest and/or the articles contacting the material of interest. The vibration sources listed herein are examples and are not intended to be limitations of the present invention.

Regardless of the source, the vibrations can be applied at a plurality of locations and in a variety of orientations. Each vibration can have a different, non-harmonic frequency and a different direction of oscillation, wherein the resulting cumulative force vector generates a semi-random movement of the material. A separate vibration source can generate each of the vibrations. Each of the vibration sources can utilize and operably connect to separate power supplies and/or frequency generators. In the embodiment shown schematically in FIG. 1, for example, two vibration sources (102 and 103) are applied to a substrate 101 that is substantially planar. The substrate 101 can be secured by a substrate mounting device 104. The two vibration sources comprise piezoelectric transducers (102 and 103) oriented such that the direction of oscillation is not normal to the target surface (i.e., the surface of interest) of the substrate. The oscillations of both sources lie substantially in the x-y plane, wherein oscillations from 102 are approximately parallel to the x-axis and oscillations from 103 are approximately parallel to the y-axis (i.e., the two sources have approximately orthogonal oscillation directions).

Since many vibration sources, for instance piezoelectric transducers, can operate as vibration "transmitters" or "receivers," they provide a method for setting up the multiple vibration sources. For example, when using two sources, the first source can generate vibrations while the second detects them. The amplitude and frequency of the first source can be tuned according to the values detected by the second. The process is then repeated with the second source now generating vibrations and the first source detecting them. Similar tuning procedures can be utilized with multiple sources of various types, including laser-based and electromagnetic-based sources.

Figure 2:
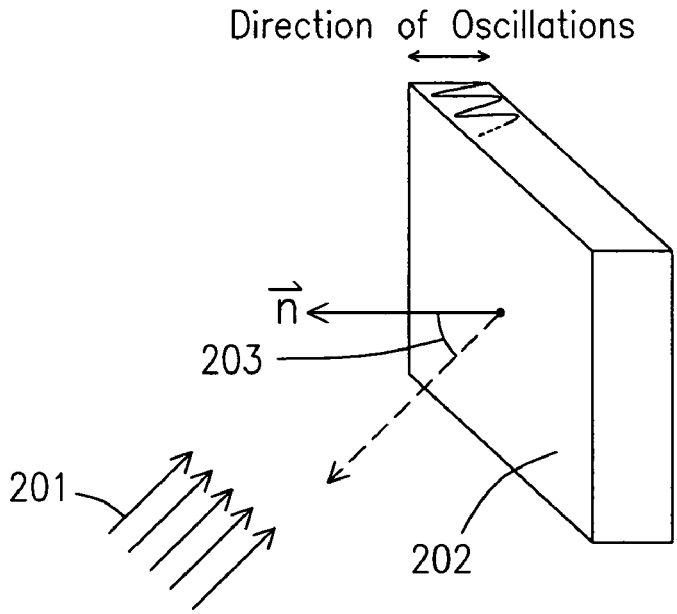
FIG. 2 is a schematic illustration of one embodiment having oscillations parallel to a surface normal.

While some applications can utilize vibrations normal to the target surface, in other cases, such vibrations are ineffective at randomizing stress vectors in the deposit. Referring to FIG. 2, one instance when surface-normal vibrations can be utilized includes, but is not limited by, deposition schemes wherein the deposit material 201 impinges the target surface 202 at an angle 203 off the surface normal, n.

Figure 3:
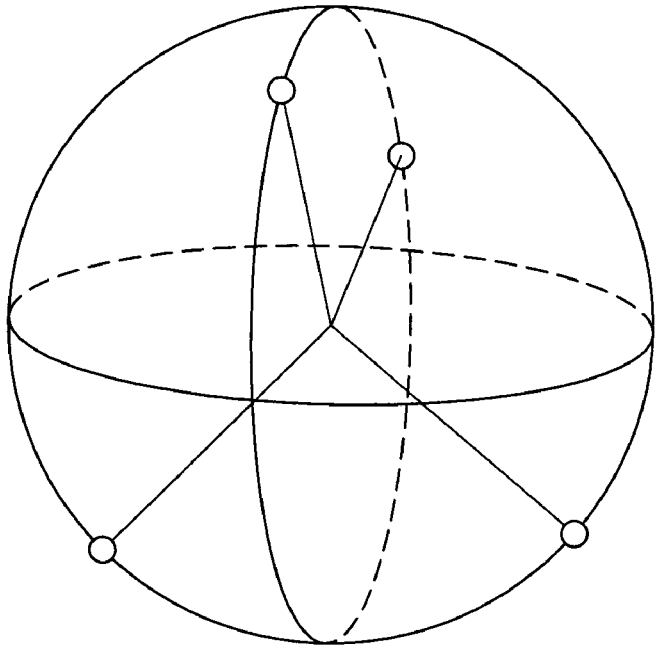
FIG. 3 is a schematic illustration of one embodiment comprising a tetrahedral arrangement of vibration sources.
Figure 4:
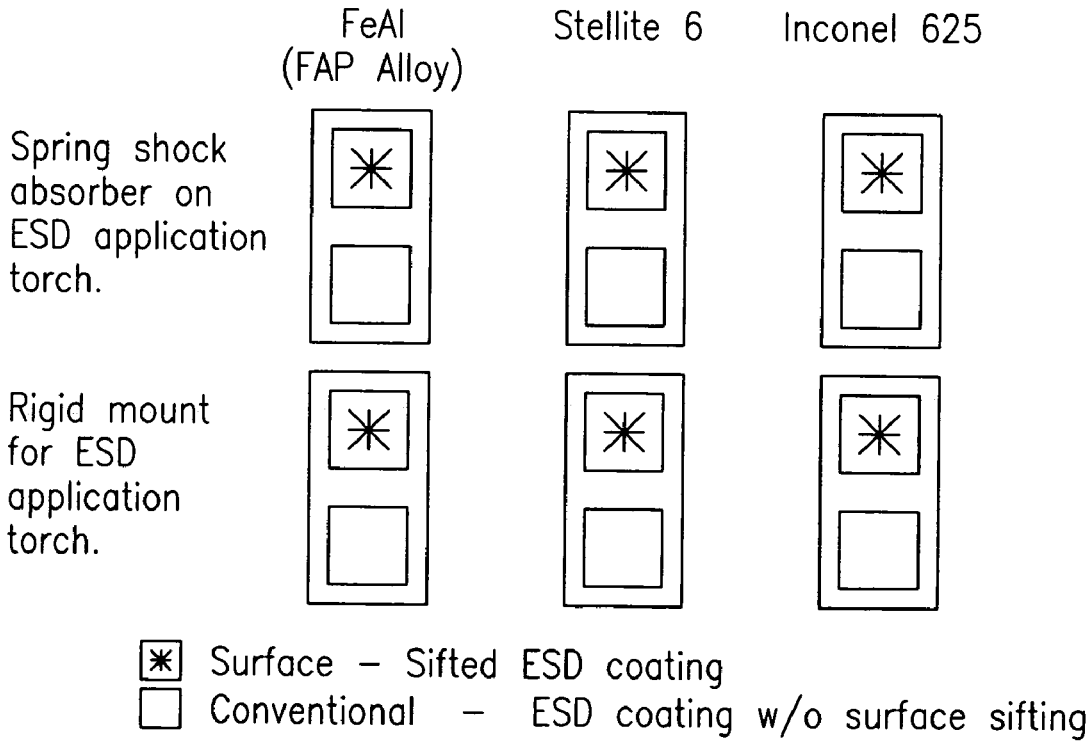
FIG. 4 is a schematic illustration of the test pattern used in an experiment comparing deposits generated with and without surface sifting.

Another embodiment can comprise at least three vibration sources wherein at least two of the sources have nonparallel planes of oscillation. For vibration sources having parallel planes of oscillation, the directions of oscillation should not be parallel. The present embodiment can be applied to substrates having a target surface that is non-planar. Referring to FIG. 3, another configuration can utilize four vibration sources placed in a substantially tetrahedral arrangement on a non-planar substrate.

The embodiments of the present invention are compatible with material systems in which stresses build during formation and can include, but are not limited to metals, alloys, ceramics, cermets, and polymers.

Example of Surface Sifting during Electrospark Deposition

ESD is a pulsed-arc, micro-welding process that uses short-duration, high-current electrical pulses to deposit a consumable electrode material on a conductive work piece. ESD has been described in detail in U.S. Pat. No. 6,835,908 by Bailey et al., which details are incorporated herein by reference.

Two ESD coatings were applied to each of two sets of three steel coupons (316 SS). Coatings applied to one set of coupons utilized a spring shock absorber on the ESD application torch. Coatings applied to the other set of coupons had a rigid brace mounted across the shock absorber. Each set of coupons had coatings comprising three materials—FeAl (FAP alloy), Stellite 6, and Inconel 625. The FAP alloy does not normally crack and served as a control to ensure that surface sifting did not introduce new problems. Stellite 6 and Inconel 625 typically suffer from moderate and significant cracking, respectively. On each coupon, one coating was generated with Surface Sifting and one coating without. Thus, the experiment contained six pairs of deposits under a variety of conditions.

In the present example, two piezoelectric transducers (i.e., vibration sources) were coupled to the stainless steel coupon (i.e., substrate) in a configuration similar to the one shown in FIG. 1. The transducers were mounted between machine-workable ceramic pieces for electrical insulation. The two piezoelectric transducers operated at frequencies of approximately 1.3 and 2 MHz with 25 V and 40 V peak-to-peak amplitudes, respectively. Argon was used as a cover gas during deposition. Each coating was then evaluated by metallographic examination for evidence of micro-cracking, porosity, and inclusions. Table 1 summarizes the results and suggests that vibrating the work piece according to embodiments of the present invention reduces the number of observable defects, thereby altering the properties of the coating.

TABLE 1

Summary of results from ESD coatings on vibrating and non-vibrating work pieces.

| Coating Material (ESD Torch Config.) | Number of Defects (no vibration) | Number of Defects (vibration) | Comments |
|---|---|---|---|
| FeAl (Rigid Torch) | 15 | 7 | |
| FeAl (Sprung Torch) | 13 | 6 | |
| Stellite 6 (Rigid Torch) | 11 | 6 | |
| Stellite 6 (Sprung Torch) | 15 | 22 | Coating from surface-sifted coating was almost 2 times thicker. |
| Inconel 625 (Rigid Torch) | n/a | n/a | Inconel 625 is not prone to cracking and served as a control. However, the number of trapped bubbles in the coatings was significantly less in the vibrated sample. |
| Inconel 625 (Sprung Torch) | n/a | n/a | |

While a number of embodiments of the present invention have been shown and described, it will be apparent to those skilled in the art that many changes and modifications may be made without departing from the invention in its broader aspects. The appended claims, therefore, are intended to cover all such changes and modifications as they fall within the true spirit and scope of the invention.

We claim:

1. A system comprising a plurality of vibration sources that impart vibrations of dissimilar, nonharmonic frequencies relative to one another, to a material, said plurality of vibration sources imparting said vibrations in at least two different directions, wherein said vibrations alter properties of said material.

2. The system as recited in claim 1, further comprising a material deposition device for depositing said material while the vibration sources impart said vibrations, the material deposition device selected from the group consisting of apparatuses for material deposition, film growth, fabrication, surface repair, bulk growth, component joining, molding, coating, electrospark deposition (ESD), spray coating, welding, spin coating, casting, high-velocity oxide spraying, and combinations thereof.

3. The system as recited in claim 1, wherein said vibrations comprise oscillations not normal to a target surface.

4. The system as recited in claim 1, wherein said vibration sources are applied to an article contacting said material.

5. The system as recited in claim 1, wherein said vibration source comprises a device selected from the group consisting of piezoelectric transducers, mechanical motors, electromagnetic devices, laser-based sources, acoustic devices, and combinations thereof.

6. The system as recited in claim 1, wherein said vibration sources are positioned at a plurality of locations.

7. The system as recited in claim 6, comprising two vibration sources having approximately orthogonal oscillation directions and having planes of oscillation approximately parallel to a target surface, wherein said target surface is substantially planar.

8. The system as recited in claim 6, comprising at least three vibration sources having nonparallel planes of oscillation.

9. The system as recited in claim 6, comprising four vibration sources having a substantially tetrahedral arrangement.

* * * * *

UNITED STATES PATENT AND TRADEMARK OFFICE

CERTIFICATE OF CORRECTION

PATENT NO. : 7,439,470 B2
APPLICATION NO. : 11/035463
DATED : October 21, 2008
INVENTOR(S) : Jeffrey A. Bailey et al.

It is certified that error appears in the above-identified patent and that said Letters Patent is hereby corrected as shown below:

On the title page under (75) Inventors, please correct the spelling of "Johnson N. Roger" to "Roger N. Johnson".

On the title page under (75) Inventors, please correct the spelling of "Munley T. John" to "John T. Munley".

On the title page under (75) Inventors, please correct the spelling of "Park R. Walter" to "Walter R. Park".

Signed and Sealed this

Thirtieth Day of December, 2008

JON W. DUDAS
*Director of the United States Patent and Trademark Office*